US009872561B1

(12) United States Patent
Alfaro

(10) Patent No.: US 9,872,561 B1
(45) Date of Patent: Jan. 23, 2018

(54) EASY ACCESS OVERHEAD CABINET APPARATUS

(71) Applicant: Gilma Liliana Alfaro, Cerritos, CA (US)

(72) Inventor: Gilma Liliana Alfaro, Cerritos, CA (US)

( * ) Notice: Subject to any disclaimer, the term of this patent is extended or adjusted under 35 U.S.C. 154(b) by 0 days.

(21) Appl. No.: 15/293,814

(22) Filed: Oct. 14, 2016

(51) Int. Cl.

| | |
|---|---|
| ***A47B 96/00*** | (2006.01) |
| ***A47B 51/00*** | (2006.01) |
| ***A47B 88/04*** | (2006.01) |
| ***A47B 88/20*** | (2006.01) |

(52) U.S. Cl.
CPC ..... *A47B 51/00* (2013.01); *A47B 88/0414* (2013.01); *A47B 88/0455* (2013.01); *A47B 88/0481* (2013.01); *A47B 88/20* (2013.01); *A47B 2051/005* (2013.01); *A47B 2220/0097* (2013.01)

(58) Field of Classification Search
CPC ..... A47B 51/00
USPC ..... 312/247, 294, 310, 312
See application file for complete search history.

(56) References Cited

U.S. PATENT DOCUMENTS

| | | | | |
|---|---|---|---|---|
| 5,867,847 | A * | 2/1999 | Klawitter | E03C 1/324 312/247 |
| 5,909,933 | A * | 6/1999 | Keene | A47L 9/10 312/140.1 |
| 6,463,862 | B1 * | 10/2002 | Kuhlman | A47B 21/0073 108/24 |
| 6,755,492 | B1 * | 6/2004 | Hyde | A47B 51/00 312/247 |
| 8,061,790 | B2 * | 11/2011 | Anikhindi | F25D 25/025 312/319.5 |
| 8,424,983 | B1 * | 4/2013 | Strauss | A47B 51/00 312/247 |
| 8,641,156 | B2 * | 2/2014 | Chow | A47B 51/00 312/247 |
| 2008/0289544 | A1 * | 11/2008 | Buitmann | A47B 9/00 108/20 |

* cited by examiner

*Primary Examiner* — Matthew W Ing

(57) ABSTRACT

In embodiments, the invention includes an apparatus for accessing a cabinet and a method of using the apparatus. The apparatus includes a drawer slidably mounted to the cabinet and a motorized axis to slide the drawer relative to the cabinet. A box slidably mounts to the drawer and includes another motorized axis to slide the box relative to the drawer. A limit device is adjustable to define a set position as the end of motion of the motorized axis that slides the drawer. The limit device is adjustable to define the extent of motion at one of a plurality of positions. The method includes providing the apparatus and adjusting the limit device to a clear position so that the box clears an obstacle when the drawer is disposed with the drawer motorized axis at the clear position, and operating the switch.

19 Claims, 5 Drawing Sheets

FIG. 6
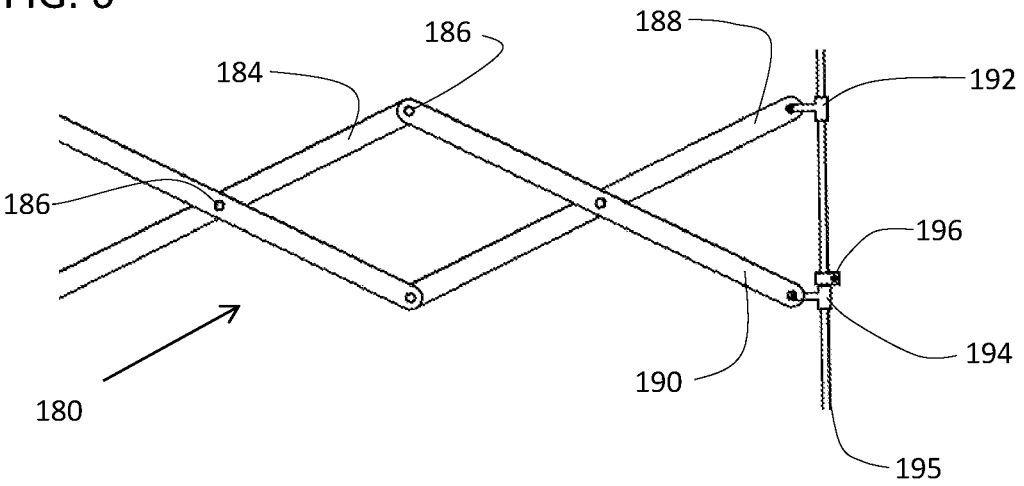
FIG. 7
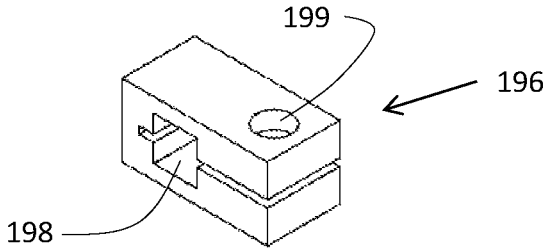
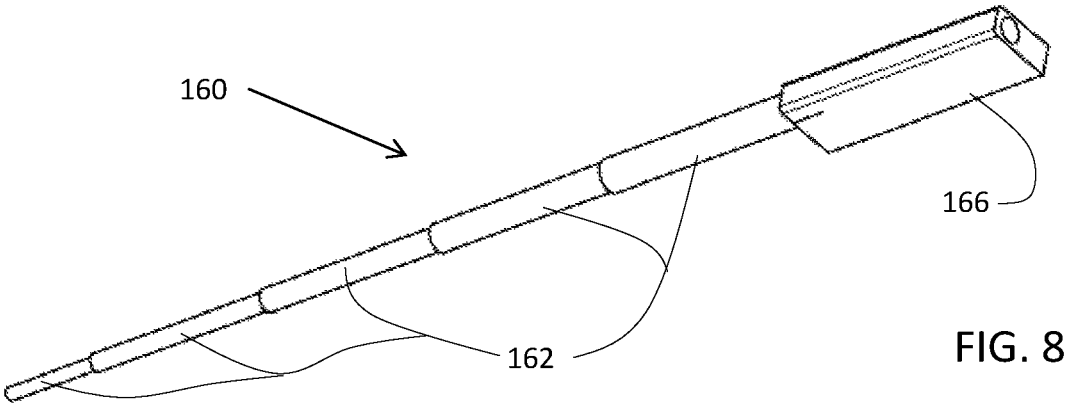
FIG. 8

EASY ACCESS OVERHEAD CABINET APPARATUS

BACKGROUND OF THE INVENTION

Field of the Invention

This invention is in the field of access to cabinets. In particular, it concerns apparatus and methods for improving access to overhead cabinets.

Certain cabinets, notably overhead cabinets, may be difficult to access because the height of the cabinet is greater than the reach of a user, making it difficult for a user to add or remove contents. This is particularly problematic when the user is confined to a wheelchair or is of small stature.

Cabinets may include motorized doors that open in an automated fashion, automated drawers that extend outward or downward from the cabinet, or automated linkage mechanisms that move contents downward and outward. However, overhead cabinets are frequently installed above appliances such as refrigerators or freezers. These appliances (or portions of the appliances such as handles) may protrude beyond the front of cabinets, causing further difficulties in accessing their contents.

Motorized doors that open in an automated fashion or automated drawers that extend outward may still leave contents above the reach of a user. Automated drawers that extend downward are only useful when the space beneath a cabinet is not used.

Cabinets with automated linkage mechanisms can use a single controlled axis to move an internal portion of a cabinet along a curved path. When cabinets are rectangular prisms, the most common space-filling shape, such a curved path would cause interference between the rear bottom portion of cabinet drawer and the front edge of a cabinet. Cabinets with automated linkage mechanisms remove a portion of the movable portion of the cabinet, diminishing storage capacity. Further, cabinets with automated linkage mechanisms trace a fixed path that cannot be reconfigured to avoid any protruding parts of appliances or other devices mounted under the cabinet.

There is thus a need for a cabinet that opens without requiring great height or strength on the part of the user, that presents the cabinet contents in an easily accessible position, that preserves storage capacity, and that avoids interference with appliances or other devices that protrude beyond the front of the cabinet.

SUMMARY

In embodiments, the invention includes an apparatus for accessing a cabinet. The apparatus includes a drawer slidably mounted to the cabinet and a motorized axis to slide the drawer relative to the cabinet. A box slidably mounts to the drawer and includes another motorized axis to slide the box relative to the drawer. A limit device is adjustable to define a set position as the end of motion of the motorized axis that slides the drawer. The limit device is adjustable to define the extent of motion at one of a plurality of positions.

In embodiments, the motorized axis that slides the drawer is perpendicular to the motorized axis that slides the box. The motorized axis that slides the drawer may be oriented horizontally and the motorized axis that slides the box may be oriented vertically.

The apparatus may also include a controller having a switch. The controller electrically connects to the two motorized axes. The motorized axes may each have home positions. When the drawer is fully retracted into the cabinet, the motorized axis that slides the drawer is at the drawer home position. When the box is fully retracted into the drawer, the motorized axis that slides the box is at the box home position.

The apparatus has an open state and a closed state. When the apparatus is in the closed state, both axes are disposed at their respective home positions. When the apparatus is in the closed state, the controller responds to the switch by moving the motorized axis that slides the drawer to the set position and advancing the motorized axis that slides the box after the other motorized axis reaches the set position as defined by the limit device. When the apparatus is in the open state, the controller responds to the switch by moving the motorized axis that slides the box to its home position and by moving the other motorized axis after the motorized axis that slides the box reaches its home position.

The switch may respond to a signal from a remote device, such as a cell phone. The signal may be a wireless signal. The limiter may include a movable stop, a movable sensor, or a programmable position of a position encoder. Either of the axes may include a linkage, a telescoping actuator, a rack and pinion, or a lead screw.

In embodiments, the invention also includes a method of accessing a cabinet including steps of providing embodiments of the apparatus described above and adjusting the limit device to a clear position so that the box clears an obstacle when the drawer is disposed with the drawer motorized axis at the clear position, and operating the switch. The method may include using a remote device including an app that wirelessly couples the remote device to the switch with the switch responding to a signal from a remote device. The app or the controller may retain a log of accesses to the apparatus.

BRIEF DESCRIPTION OF THE DRAWINGS

FIG. 6 shows a top view of a portion of the extension actuator of the embodiment of FIG. 5.

FIG. 7 shows a perspective view of the limit set device of the embodiment of FIG. 6.

FIG. 8 shows a perspective view of the telescoping actuator of the embodiment of FIG. 4.

DETAILED DESCRIPTION OF THE INVENTION

In embodiments, the invention includes an apparatus and a method of using the apparatus. The descriptions below refer to the apparatus in its normally used orientation. In this orientation, the drawer slides out the front of the cabinet, and the box descends below the bottom of the cabinet.

Figure 9:
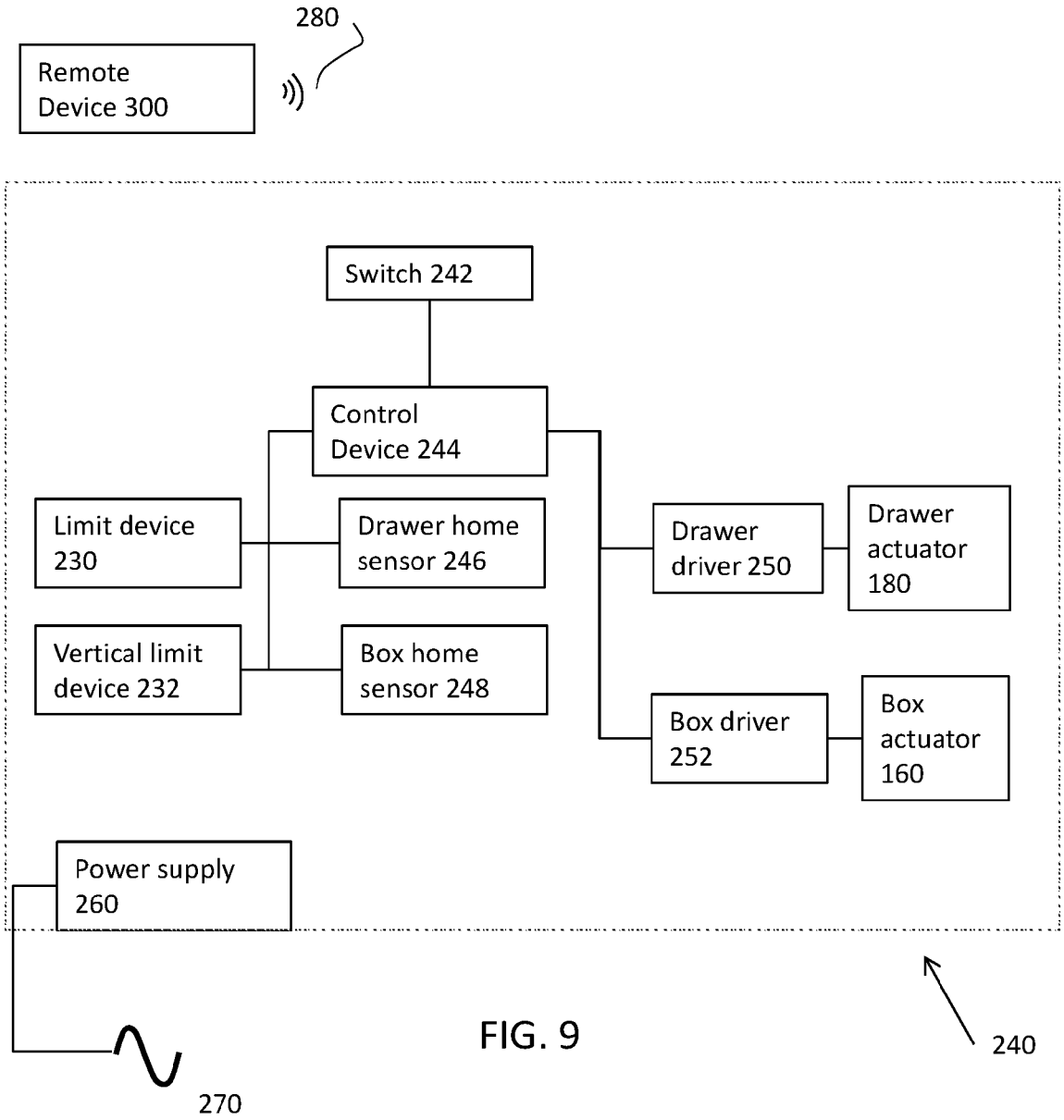
FIG. 9 shows a schematic illustration of an embodiment of a controller of the invention.

Referring to FIGS. 1-5, the apparatus of the invention includes embodiments 10 that have a cabinet 100, a drawer 120, a box 140, and a controller 240 (FIG. 9).

Cabinet 100 includes a hollow housing with back 110, sides 112 and 114, bottom 116, and top 118. Cabinet 100 also includes drawer slides mounted to sides 112 and 114 and a motorized axis. Drawer slides and motorized axis are described in more detail below.

The purpose of the walls of cabinet 100 is to support mechanical components and to enclose drawer 120 and box 140. In some embodiments, cabinet 100 may include doors (not shown). Only a subset of the walls of cabinet 100 are necessary to support mechanical components, and the enclosure function can be distributed between drawer 120, box 140, and other parts of the location where the apparatus is installed (such as room ceiling and walls and the sides of adjacent cabinets). In some embodiments, some of back 110, sides 112 and 114, bottom 116, and top 118 may not be present. For example, top 10 and back 110 may be absent with mechanical components attached only to bottom 116 and sides 112 and 114. In other embodiments bottom 116 may be absent with mechanical components attached only to sides 112 and 114.

Drawer 120 includes a rectangular housing that slides outward from cabinet 100 when the apparatus opens. The size of drawer 120 approximates the size of the interior of cabinet 100 with clearance for the drawer slides and motorized axis. Drawer 120 includes drawer back 122, drawer sides 124 and 126, and drawer front 128. Drawer 120 has an open bottom to permit box 140 to descend as the apparatus opens. Drawer 120 also includes drawer slides 206 and 208 and a motorized axis mounted to drawer back 112 and described in more detail below. In the illustrated embodiment, drawer sides 124 and 126, and drawer front 128 are relatively short as compared to the internal height of cabinet 100 to reduce weight of drawer 120. Alternatively, at least drawer front 128 may approach the full height of cabinet 100 to act as a door that closes off the interior of cabinet 100 when apparatus 10 is fully closed.

Box 140 is a closed bottom platform that descends from within drawer 120 when the apparatus opens. The size of box 140 approximates the size of the interior of drawer 120 with clearance for the box slides and motorized axis so that box 140 nests within drawer 120, which in turn nests within cabinet 100 when the apparatus is closed. Box 140 includes box bottom 142, box sides 144 and 146, box front 148, and box back 150. The purpose of box bottom, 142 box sides 144 and 146, and box front 148 is to retain the contents of cabinet 100 and present them for access. Box back 150 is full height to accommodate maximal length box slides. In the illustrated embodiment, box sides 144 and 146, and box front 148 are relatively short as compared to the internal height of cabinet 100. This permits easy access for a user to reach into box 140 to arrange and access contents. In some embodiments, box sides 144 and 146 and box front 148 may extend the full height of the inside of cabinets 100 to accommodate loose or bulk items.

The illustrated embodiment includes two sets of slides that slidably couple drawer 120 to cabinet 100 and box 140 to drawer 120. Drawer slides 202 and 204 couple cabinet 100 to drawer 120. Box slides 206 and 208 couple drawer 120 to box 140. The two sets of slides are oriented perpendicularly to one another; motion of drawer 120 on drawer slides 206 and 208 is horizontal, and motion of box 140 on box slides 206 and 208 is vertical. The slides support the load of the drawer on the cabinet (and of the box in the drawer) and allow low-friction linear sliding motion between the respective parts.

Slides may be telescoping with a fully extended length that exceeds twice the length of the slides in the unextended state. This "over extension" allows drawer 120 to extend fully beyond the confines of cabinet 100 so that, box 140 extending downward from drawer 120 can avoid any obstacles that project beyond the depth of cabinet 100. Use of over extension box slides allows box 140 to reach a lower height in the fully open position. This lower height may make cabinet contents be more accessible to some users. In embodiments, slides may be four-beam ball bearing slides with over extension, such as model RA414 manufactured by Chambrelan SA of Le Havre, France, with lengths selected as appropriate for the size of the apparatus. In other embodiments, the apparatus may include one or more intermediate platforms with two or more sets of slides. The intermediate platform couples to cabinet 100 via a first set of slides and to drawer 120 via a second set of slides, thus delivering the necessary over extension with conventional slides, albeit with a decrease in accessible volume. In still other embodiments, the apparatus may include other types of slides known in the art.

In the illustrated embodiment, slides 202 and 204 are mounted to respective sides 112 and 114 of cabinet 100 and are coupled to the outer aspect of drawer side 124 and 126. This arrangement distributes the load of drawer 120 and provides a large mounting surface for the end of the slides coupled to drawer 120. Alternatively right slide 202 may mount to bottom 116 of cabinet 100 and couple to the lower aspect of drawer sides 124 and 126. In still other embodiments, drawer 120 may include a drawer top (not shown) with slides 200 mounted to the top 118 of cabinet 100 and coupled to the drawer top. In such embodiment, a single slide 200 may serve to couple cabinet 100 to drawer 120. This has the benefit of reducing cost of the apparatus.

Figure 1:
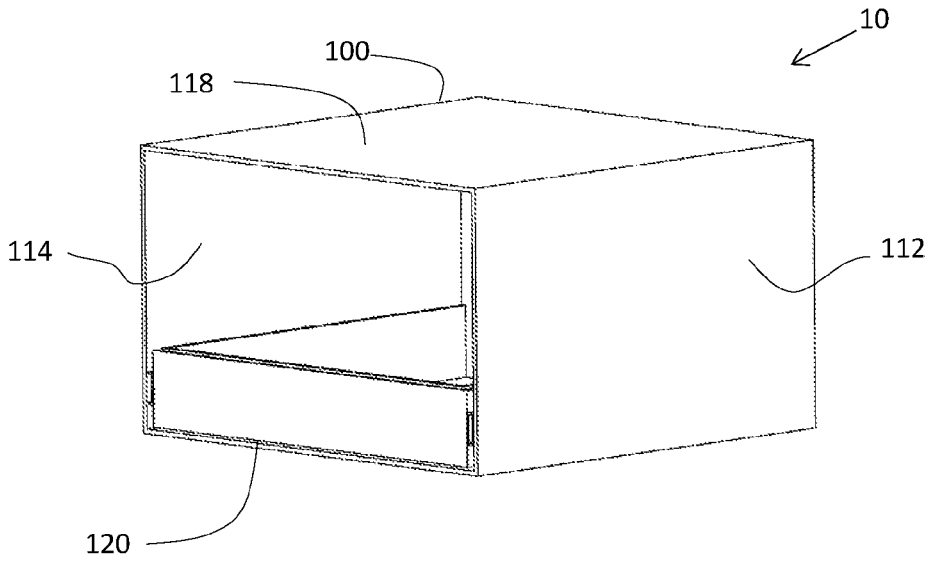
FIG. 1 is an isometric illustration of an embodiment of the apparatus of the invention shown in the closed state.
Figure 2:
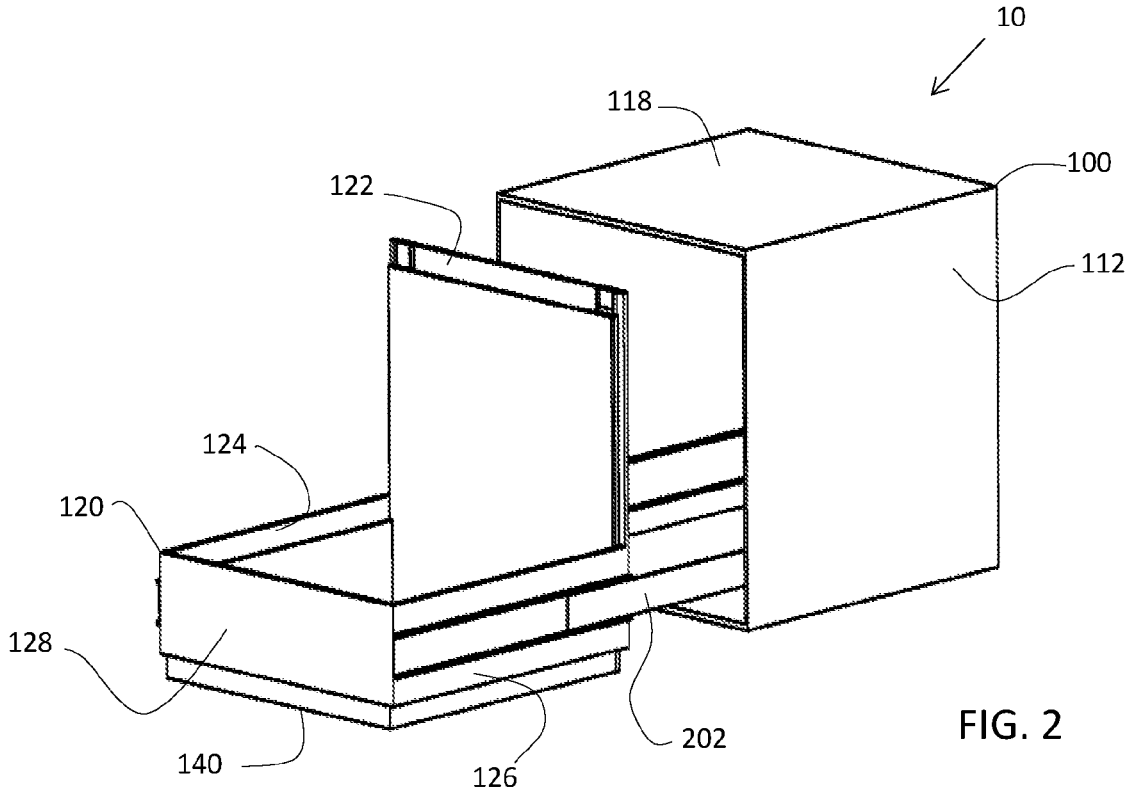
FIG. 2 shows the embodiment of FIG. 1 in a partially open state.
Figure 3:
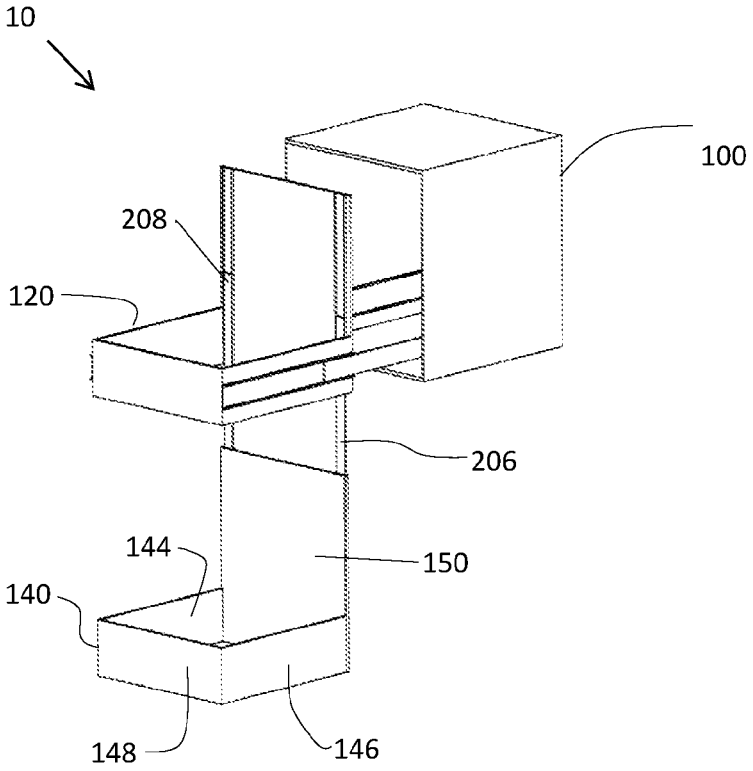
FIG. 3 shows the embodiment of FIG. 1 in a fully open state.
Figure 4:
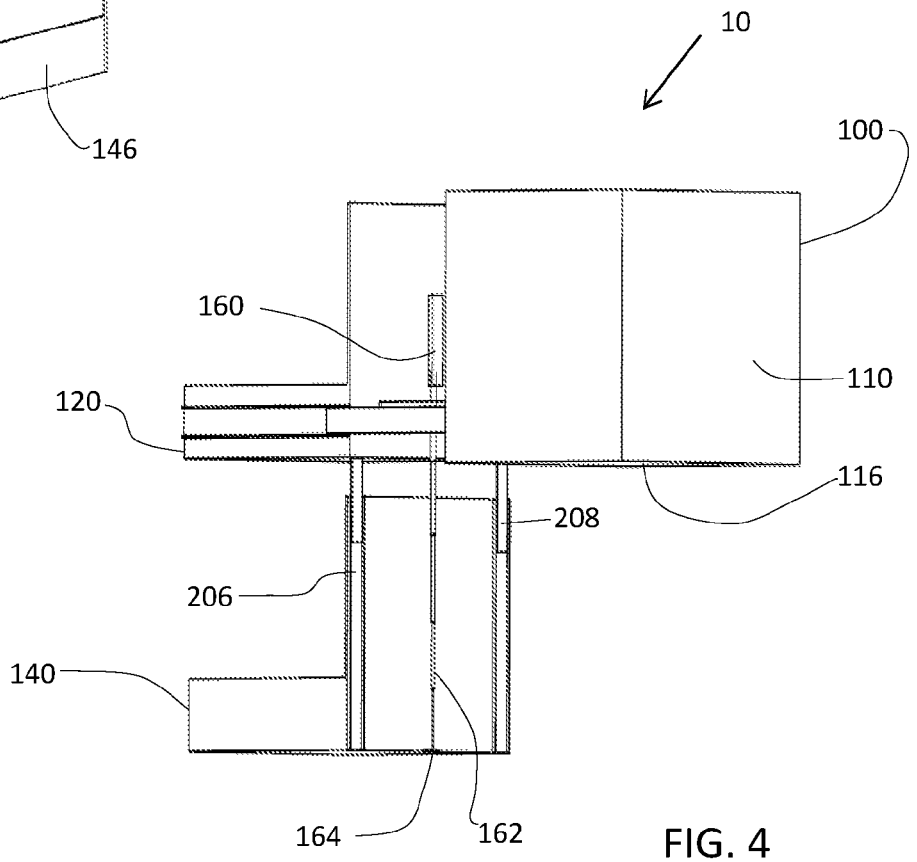
FIG. 4 shows a rear oblique view of the embodiment of FIG. 3.

In the illustrated embodiment (as best seen in FIGS. 3 and 4), box slides 206 and 208 are mounted to the front aspect of drawer back 122. The second end of box slides 206 and 208 couples to the rear aspect of box back 150.

Both drawer 120 and box 140 are driven by motorized axes. The purpose of each motorized axis is to move the attached enclosure along the respective slides. Many different mechanisms are applicable as motorized axes. Among these are rack and pinions, linkages, telescoping actuators (which may be pneumatic, hydraulic, or electrical), lead screw or ball screw actuators, belt and pulley drives, chain drives, or band drives. Any of these actuators, or others with similar function, may serve as actuators for movement of either the drawer 120 or box 140. The illustrated embodiment shows a linkage actuator (similar to a scissor lift) as the drawer actuator and a telescoping actuator as the box actuator. The skilled practitioner will recognize that other actuator types may be employed for either axis.

Figure 5:
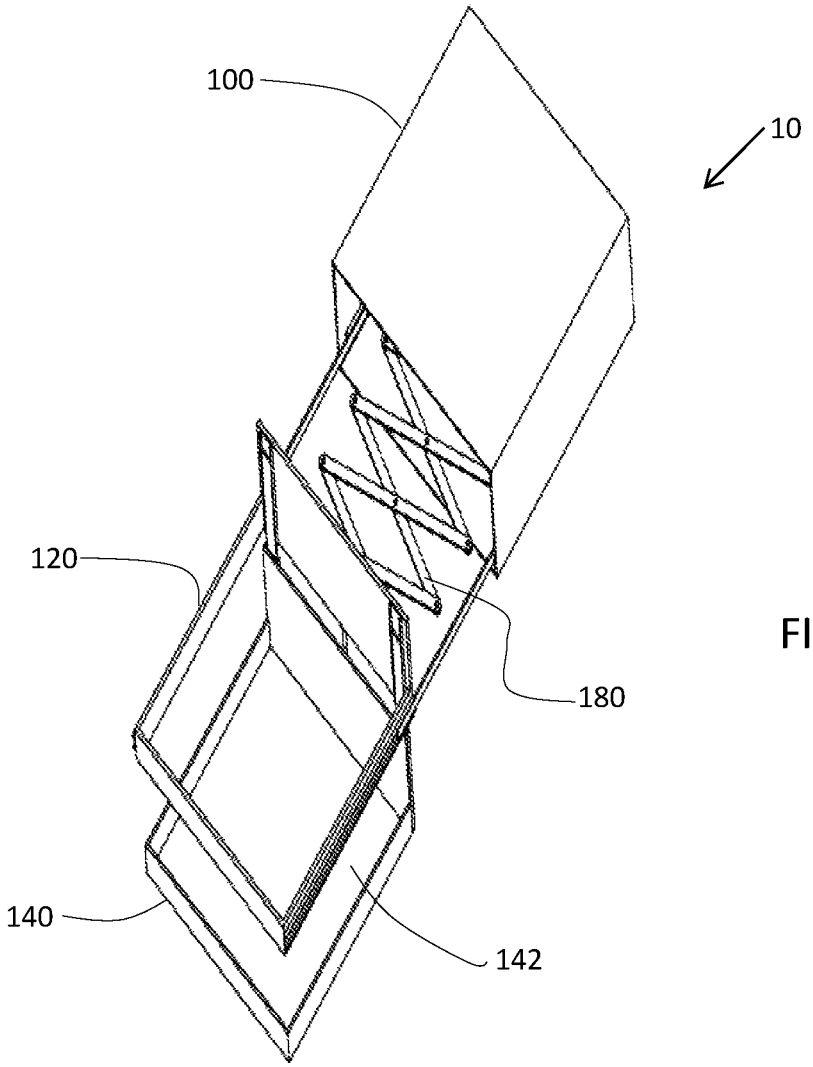
FIG. 5 shows a top perspective view of the embodiment of FIG. 3.

Referring to FIG. 5 and FIG. 6, drawer actuator 180 includes a familiar scissor linkage comprising a plurality of elongated rigid links 184 joined by rotatable joints by pivots 186. The links 184 are arranged in pairs joined by pivots 186 at their midpoints, with each pair joined to another pair by pivots 186 near one end of each link 184. The last links 188 and 190 in the assembly are attached to a slide rod 195 via additional pivots to link slides 192 and 194. Slide rod 195 is mounted to the rear aspect of drawer back 122. At the opposite end (not shown), and tied to the back 110 of cabinet 100, one of the first links is coupled via an additional pivot to a moving nut of a motor-driven lead screw. As the lead screw advances, the end points of the first links approach one another and the linkage assembly extends along the length of the cabinet, thus driving the drawer outward. At least one of link slides 192 and 194 is free to slide along slide rod 195 to accommodate the changing separation distance between last links 188 and 190. In some embodiments, one of link slides 192 and 194 is fixed to slide rod 195. Reversing the direction of motor rotation drives the end points of the first links apart, retracting the drawer inward.

The scissor linkage advantageously provides a mechanism that is capable of compact storage in the unextended state and a long length of extension. The compact storage provides the benefit of preserving storage capacity of the apparatus.

Referring to FIG. 4 and FIG. 8, box actuator 160 comprises a telescoping actuator including multiple telescoping tubes 162 and mechanism housing 166. Each of the telescoping tubes includes an axially aligned nut at its lower end that engages the next outer tube. A motor within the actuator drives a central spindle that causes one tube after the other to extend after the preceding one has attained fully extended position. Reversing the direction of the motor retracts the tubes in reverse order. Actuators of this type are described in U.S. Pat. No. 4,793,197 to Petrovsky, et al.

Mechanism housing 160 may be affixed to a surface of drawer back 122 with telescoping tubes 162 oriented to extend downward. Retainer 164 is mounted to the box bottom 142 and extends rearward to the centerline of telescoping tubes 162. The last to extend of tube of telescoping tubes 162 is affixed to retainer 164 so that box 140 descends and rises as box actuator 160 extends and contracts.

A benefit of the telescoping actuator as box actuator 160 is that the telescoping actuator reduces possibly injurious pinch points as compared to the scissor linkage. This problem does not arise with drawer actuator as the scissor linkage does not come in close contact to the user. The available height of drawer back 122 allows use of an actuator that does not fold as compactly as the scissor actuator.

The apparatus includes at least one limit device 230 and may include a vertical limit device 232. The purpose of limit device 230 and vertical limit device 232 is to define the extent of motion. Limit device 230 defines the minimum extent that drawer 120 slides outward from cabinet 100. Limit device 230 needs to be set upon installation of the apparatus so that box 140, upon descending from drawer 120, does not collide with obstructions that may be present beneath cabinet 100. Appliances, such as refrigerators, have components that protrude beyond the normal depth of overhead cabinets. Even appliances sold as "cabinet depth" extend six inches or more beyond the normal depth of a cabinet.

A wide variety of limit devices may be used to set the minimum extent that drawer 120 slides outward from cabinet 100. These include position encoders, movable limit switches or flags, and hard stops. Any of these may be used as limit device 230 or as vertical limit device 232. The illustrated embodiment uses a type of hard stop as limit device 230. This is clamp 196 mounted on rod 195. Clamp 196 includes a rod hole 198 sized to fit over rod 195. A screw hole 199 perpendicular to rod hole 195 accommodates a screw (not shown) that locks clamp 196 onto rod 195 at a desired position. To determine the appropriate position, an installer extends drawer 120 out from cabinet 100 to the desired minimum extent, making sure that box 140 in descending from this position would clear any obstacles such as refrigerator doors. Installer then tightens the screw to lock clamp 196 in position on rod 195 in contact with link slide 194. During subsequent extensions of drawer 120, link slide 194 will approach clamp 196 at the set position until the two parts contact. Control device 244 senses the increased load through drawer driver 250 and stops further motion. Benefits of using clamp 196 as limit device 230 include that it is relatively easily accessible during installation (as compared to alternate positions within cabinet 100), and that no adjustable wires need to span from cabinet 100 to drawer 120.

When limit device 230 includes a position encoder, the user can set the desired position programmatically, such as by using the app in the remote device described below.

Referring to FIG. 9, controller 240 includes a switch 242, drivers 250 and 252 to operate the respective actuators for each of the motorized axes, and a control device 244. Controller 240 may also include a power supply 260, preferably connected to electrical mains power 270 to supply electrical energy for the apparatus.

Switch 242 provides input from a user to indicate that the apparatus should open or close (or, in some embodiments, stop opening or stop closing). Switch 242 may be a conventional electrical contact, such as a membrane switch, momentary action micro switch, or a non-contact proximity sensor. Alternatively, switch 242 may include an optical interrupter or a capacitive touch sensor, which may provide improved performance in dirty environments.

In embodiments, the switch input function may also be provided by a remote device 300, such as a cell phone, a tablet, personal computer, or a home control system. Remote device 300 includes an application (an app, not shown) that causes remote device 300 to communicate the user's input via a wireless connection 280 to controller 240. The user input can use any inputs available in a remote device. Among these user inputs are biometric sensors, such as fingerprint sensors, that can provide a secure control openable only by a designated user for added security. Other user inputs include voice recognition, password entry, or key control that provide a range of security and ease of use. Remote device 300 may also control the switch input function in conjunction with a home security system or home automation system.

Wireless connection 280 may use any of a number of known protocols, such as Bluetooth (a registered trademark of Bluetooth SIG, Inc.), WiFi (a registered trademarks of Wi-Fi Alliance), infrared, or near field communications. Wireless connection 280 permits a user to operate the apparatus using a familiar operator interface that users frequently carry. In some embodiments, wireless connection 280 may be used for secure operation from a distance, such as when a cabinet contains materials, such as medications, toxic or corrosive chemicals, or confidential documents, where access should be limited or controlled. In such embodiments, the application in remote device 300 or control device 244 in the apparatus may keep a record of operations to provide an audit trail.

Drivers 250 and 252 connect to their respective actuators supply properly conditioned, timed, and powered signals to drive the actuators and may include any of a variety of electrical controls suitable for the motors used in the motorized axes. For example, when the motorized axes include a stepping motor, one of drivers 250 and 252 include a stepper motor driver such as the G250X Digital Step Drive manufactured by Geckodrive, Inc. of Santa Ana, Calif.

Control device 244 may include any of a number of conventional electronic or electrical devices suitable for responding to switch 242 and to the position sensors (including home position sensors 246 and 248, limit device 230, and vertical limit device 232) and for electrically actuating the motorized axes. In embodiments, control device 244 may include discrete logic, a programmable logic controller, or relay logic, but preferably the control device 244 includes a microprocessor specifically programmed for the task. Any of a variety of low cost single-chip microcontrollers, such as a PIC10F204 produced by Microchip Technology of Chandler, Ariz. may be suitable. Control device 244 accepts input from switch 242, from sensors such as home position sensors 246 and 248, and where appropriate, from limit device 230 (and vertical limit device 232 where present) or the motorized axes. Where switch 242 responds to a remote device 300, control device 244 or switch 242 may include a receiver to receive the signal sent by remote device 300 and a transmitter to respond to remote device 300 with status information, such as the state of the sensors or whether an axis is in motion.

In operation, user or installer adjusts the position of limit device 230 to a desired set position as described above. If present, user or installer may also adjust vertical limit device 232 to a desired vertical set position in a similar fashion to define the maximum downward extent of travel for box 140. This position is determined by the reach of the user to minimize work in accessing the cabinet.

Home position sensors 246 and 248 sense when each axis is fully withdrawn. When both axes are at their home positions, the apparatus is fully closed as in FIG. 1. When drawer 120 is fully extended to the set position, the apparatus is partially open as in FIG. 2. When box 140 is fully extended to the set position (or to the end of travel if no vertical limit device is present), the apparatus is fully open as in FIGS. 3-5.

The controller is programmed so that, when the apparatus is in the closed position, detection of user input at switch 242 triggers control device 244 to extend drawer actuator 180 through command to drawer driver 250. Extension continues until control device 244 detects that drawer 120 has reached the set position. Control device 244 then extends box actuator 160 through command to box driver 252. Extension continues until control device 244 detects that box 140 has reached the vertical set position (or to the end of travel if no vertical limit device is present).

When the apparatus is in the closed position, the controller is programmed to reverse the process upon detection of user input at switch 242. First the control device 244 retracts box 140 until the box home sensor is detected. Control device 244 then retracts drawer 120 until the drawer home sensor is detected.

The apparatus may include various safety features such as stopping operation upon receipt of a second signal from the switch and reversing operation upon a subsequent signal even if the apparatus has not yet reached its fully open or fully closed state. The apparatus may also stop operation on detection of an above normal load to one of the actuators. In some embodiments, the apparatus may include additional sensors to detect whether an obstruction, such as a user or an open appliance door, may be near the path of operation. The additional sensors may include a non-contact proximity sensor. The controller, upon detecting a signal from such a sensor, may be programmed to abort operation until the obstruction is cleared.

The apparatus may also include automatic closure features if the apparatus is left open for longer than a predetermined time. This may be incorporated either in control device 244 or in a remote device 300 or in some combination.

In other embodiments, the apparatus may include a conversion kit to convert a conventional overhead cabinet to include the automated functionality disclosed above. Such a conversion kit may include any subset of the described components necessary to convert a conventional cabinet to the device described above. This may include extended length overtravel slides for both axes, the drawer, box, and limit components, as well as the control device, the motorized axes, and instructions for installation and operation.

This specification discloses various aspects of the invention with reference to particular embodiments, but it should be understood that any of the features, functions, materials, or characteristics may be combined with any other of the described features, functions, materials, or characteristics. The description of particular features, functions, materials, or characteristics in connection with a particular embodiment is exemplary only; it should be understood that it is within the knowledge of one skilled in the art to include such feature, structure, or characteristic in connection with other embodiments whether or not explicitly described. I intend the scope of the appended claims to encompass such alternative embodiments. Variations on these described embodiments will become apparent to those of ordinary skill in the art upon reading the description. The inventor expects skilled artisans to employ such variations as appropriate, and the inventors intend for the invention to be practiced otherwise than specifically described herein. Accordingly, this specification and claims include all modifications and equivalents of the subject matter recited in the claims appended hereto as permitted by applicable law.

Unless otherwise indicated, all numbers used in the specification and claims are to be understood as being modified in all instances by the term "about." Unless indicated to the contrary, the numerical values in the specification and attached claims are approximations that may vary depending upon the desired properties sought to be obtained. The disclosure of each document (including each patent application or patent) described in this document is incorporated by reference herein. In the event of a conflict between this document and the content of documents incorporated by reference, this document shall control.

The terms "a," "an," "the" and similar referents used in the context of describing the invention (especially in the context of the following claims) are intended to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the claims. No language in the specification should be construed as indicating any non-claimed element essential to the practice of the invention.

I claim:

1. An apparatus for accessing a cabinet, the apparatus comprising:

a drawer slidably mounted to the cabinet and including a first motorized axis to slide the drawer relative to the cabinet, wherein the first motorized axis is oriented horizontally;

a box slidably mounted to the drawer and including a second motorized axis to slide the box relative to the drawer, wherein the second motorized axis is oriented vertically; and a limit device to limit motion of the first motorized axis to a set position, wherein the limit device is adjustable to define the set position at one of a plurality of positions on the first motorized axis.

2. The apparatus of claim 1, wherein the first motorized axis is perpendicular to the second motorized axis.

3. The apparatus of claim 1, further comprising a controller including a switch, the controller electrically connected to the first motorized axis and to the second motorized axis.

4. The apparatus of claim 3, wherein the first motorized axis has a first home position, the drawer fully retracted into the cabinet when the first motorized axis is at the first home position, and wherein the second motorized axis has a second home position, the box fully retracted into the drawer when the second motorized axis is at the second home position.

5. The apparatus of claim 4, wherein the apparatus is configurable in an open state and a closed state, the apparatus in the closed state having the first axis disposed at the first home position and the second axis disposed at the second home position.

6. The apparatus of claim 5, wherein, when the apparatus is in the closed state, the controller is configured to respond to the switch by moving the first motorized axis to the set position and advancing the second motorized axis after the first motorized axis reaches the set position.

7. The apparatus of claim 6, wherein, when the apparatus is in the open state, the controller is configured to respond to the switch by moving the second motorized axis to the second home position and by moving the first motorized axis after the second motorized axis reaches the second home position.

8. The apparatus of claim 3, wherein the switch responds to a signal from a remote device.

9. The apparatus of claim 8, wherein the signal is a wireless signal.

10. The apparatus of claim 1, further comprising a vertical limit device to limit motion of the second motorized axis to a vertical set position, wherein the vertical limit device is adjustable to define the vertical set position at one of a plurality of vertical positions on the second motorized axis.

11. The apparatus of claim 1, wherein the limit device includes a movable stop, a movable sensor, or a programmable position of a position encoder.

12. The apparatus of claim 1, wherein the first motorized axis includes a linkage, a telescoping actuator, a rack and pinion, or a lead screw.

13. A method of accessing a cabinet, the method comprising:

providing the apparatus of claim 3;

adjusting the limit device to a clear position so that the box clears an obstacle when the drawer is disposed with the first motorized axis at the clear position; and operating the switch.

14. The method of claim 13, wherein the controller senses operation of the switch and extends the first motorized axis to the clear position, and wherein the controller extends the second motorized axis when the first motorized axis reaches the clear position.

15. The method of claim 13, wherein the apparatus further includes a vertical limit device disposed on the second motorized axis, and wherein the method further includes the step of adjusting the vertical limit device to an access position.

16. The method of claim 13, wherein the switch responds to a signal from a remote device, the remote device including an app that wirelessly couples the remote device to the switch.

17. The method of claim 15, wherein the app or the controller retains a log of accesses to the apparatus.

18. A conversion kit for an overhead cabinet comprising a switch, horizontal and vertical motorized axes, first and second overtravel slides, a control device configured to electrically couple to the horizontal and vertical motorized axes and to the switch, and a limit device configured to limit travel of the horizontal motorized axis wherein the limit device is adjustable to define the set position at one of a plurality of positions on the horizontal motorized axis.

19. The conversion kit of claim 18 further comprising an app configured to run on a remote device and to operate the switch in response to input from the remote device.

* * * * *